US005891609A

United States Patent [19]

Papai

[11] Patent Number: 5,891,609

[45] Date of Patent: Apr. 6, 1999

[54] PHOTOGRAPHIC COLOR DEVELOPER REPLENISHING CONCENTRATES

[75] Inventor: Laszlo Papai, Ballwin, Mo.

[73] Assignee: Trebla Chemical Company, St. Louis, Mo.

[21] Appl. No.: 991,591

[22] Filed: Dec. 15, 1997

[51] Int. Cl.[6] ..... G03C 7/413

[52] U.S. Cl. ..... 430/466; 430/486

[58] Field of Search ..... 430/466, 486

[56] References Cited

U.S. PATENT DOCUMENTS

| | | | |
|---|---|---|---|
| 3,276,875 | 10/1966 | Schwalenstocker | 96/66 |
| 3,479,349 | 11/1969 | Allison et al. | 260/240 |
| 3,589,921 | 6/1971 | Allison et al. | 106/137 |
| 4,232,113 | 11/1980 | Marchesano | 430/450 |
| 4,987,060 | 1/1991 | Marchesano | 430/434 |
| 5,376,510 | 12/1994 | Parker et al. | 430/466 |

FOREIGN PATENT DOCUMENTS

| | | | |
|---|---|---|---|
| 0793141A2 | of 0000 | European Pat. Off. | G03C 7/413 |
| 0800111A1 | of 0000 | European Pat. Off. | G03C 5/26 |

*Primary Examiner*—Hoa Van Le

*Attorney, Agent, or Firm*—Marianne Fuierer; Howard M. Ellis

[57] ABSTRACT

Improved one-part concentrated color developing replenishers and methods of preparation thereof comprising a photographically inert single ring heterocyclic amide. The replenisher concentrates are packaged in a single unit which upon dilution provides ready-to-use replenishing solutions for photographic materials. The concentrated replenishers are characterized by a one-part multi-phase concentrate wherein developing agents are retained in an upper phase and protected from deterioration which normally occurs in the highly alkaline lower phase.

33 Claims, No Drawings

PHOTOGRAPHIC COLOR DEVELOPER REPLENISHING CONCENTRATES

TECHNICAL FIELD

The present invention relates in general to photographic development and in particular to compositions and methods for making multi-phase concentrated replenishing solutions for color developing of photographic materials, packaged in a single unit which upon dilution provides ready-to-use replenishing solutions for photographic materials.

BACKGROUND OF THE INVENTION

In the processing of color film or prints the maintenance of developer activity is necessary for uniform development. In recent years, it has become the practice to introduce a replenishing solution to the developing solution in order to replace depleted chemicals of the processing solution and the solution carried away. Unless this is done there will be a build-up of reaction by-products formed as development progresses. Also, the concentration of reaction by-products may in time exceed the concentration of developing agent. As the reaction by-products increase the probability of the developer agent being absorbed by the silver halide grain decreases, and the likelihood of uneven development increases. Hence, replenishment requires restoration of developing agents, preservatives and usually alkali, since their concentrations fall during the developing process.

A wide range of photographic replenishers are known in both ready-to-use solutions and compounded forms. The compounded forms include liquid concentrates, which have only to be diluted with water to obtain a working strength solution, and powder types which have to be dissolved in solution. Both the ready-to-use and compounded forms present some individual problems ranging from difficulty of uniform mixing of components in the compounded forms to the high cost of shipping the extra weight of water volume in a ready-to-use solution.

The ready-to-use replenishing solutions are convenient for the user, but their large size makes shipping more expensive, and the containers take up valuable storage space. To overcome these disadvantages, there has been a trend to reduce the size of the packaging, and thus, subsequently providing a savings on shipping costs. One way to achieve this goal is to make either an all-powder or a liquid concentrate replenishing composition.

Typically, powder mixes are dissolved and brought to working strength with the addition of water. However, powdered replenishing compositions can be difficult to dissolve, especially if caking of the powder components occurs. Furthermore, powder mixes contain many substances which react with each other by an oxidation-reduction reaction necessitating the packaging of the components separately. The mixing of the components must be deferred until the time a working solution is actually used.

Liquid concentrates are an alternative to the powder mixes, but the increased water volume makes them more expensive to ship, handle and store than the powder mixes. While a higher degree of concentration will reduce some of the volume of liquid it also presents several additional problems. Because of the high dilution required to obtain working strength solutions, the concentrates usually contain maximum levels of photographic processing ingredients. However, because most developing agents are less soluble in a solution with a high pH than in a solution with a neutral pH it can be difficult to increase the concentration of the included developing agent without compounds coming out of solution.

It is no less significant that with concentrated liquid replenishers there is a marked deterioration of developing agents. This is due to a number of reasons including: high alkalinity of most replenishing solutions, decomposition of sulfites in the replenishing composition to sulfur dioxide with the subsequent degradation of the developing agent and possible hydrolysis of the oxidation product of some developing agents. Heretofore, to overcome the forgoing problems, replenishers have been packaged and shipped as multi-part liquid systems, packaging incompatible ingredients into separate containers to protect the developing agent, for example, from deterioration. The separate parts are mixed together immediately prior to being used. Of course, this method may protect the developing agents, but also raises the level of possible mishaps in the preparation regime, lack of convenience, additional needs for storage space and increased shipping costs.

Accordingly, there is a need for improved one-part liquid concentrated replenishers which can be shipped economically, require minimal storage space, eliminate the need for mixing several different components, provide for high concentrations of developing agents, and prevent deterioration of developing agents in the concentrate.

SUMMARY OF INVENTION

Therefore, according to the present invention there is provided one-part multi-phase liquid concentrated color developing replenisher compositions comprising a photographically inert single ring heterocyclic amide.

It is an object of this present invention to provide a one-part multi-phase concentrated replenishing solution comprising:

an inorganic antioxidant agent;

a color developing agent;

a photographically inert single ring heterocyclic amide;

a alkaline pH adjusting agent; and an inorganic buffering salt.

The present invention can include additional photographic processing agents; for example, optical brighteners, chelating agents, wetting agents, and additional antioxidant agents.

The one-part multi-phase concentrated replenishing solution is characterized by (1) an aqueous lower phase comprising the inorganic antioxidant, the inorganic buffering salt and the alkaline pH adjusting agent dissolved in the aqueous solution, the aqueous solution having a pH above 10 and (2) an upper phase comprising the color developing agent and the photographically inert single ring heterocyclic amide wherein the color developing agent is retained and more soluble in the photographically inert single ring heterocyclic amide thereby protecting the color developing agent from unwanted deterioration in the alkaline aqueous solution.

It has been found that the oxidation and decomposition of the color developing agent can be avoided by retaining the developing agent in the upper phase away from the aqueous alkaline lower phase of the concentrate. This is especially true with color developers, such as substituted p-phenylenediamines because the oxidation products tend to undergo deamination in highly alkaline solutions. With the protection of the developing agent, the one part multi-phase replenishing solutions have extended shelf life with little or no deterioration of the developing agent before dilution with water to provide a working solution.

With the addition of the alkaline pH adjusting agent, the pH of the aqueous solution containing the color developing agent, inorganic antioxidant agent, and photographically inert single ring heterocyclic amide is elevated from about 10 to about 12. With the addition of a sufficient amount of the inorganic buffering salt, the photographically inert single ring heterocyclic amide is pushed out of the ionic alkaline aqueous solution to achieve the desired separation. Both the developing agent and the photographically inert single ring heterocyclic amide collect in the upper phase of the multi-phase solution causing the developing agent to become concentrated in the photographically inert single ring heterocyclic amide.

It is a further object of this present invention to provide a single unit package containing all active ingredients of the one-part multi-phase concentrated replenishing solution capable of dilution to a ready-to-use replenishing solution for color developing of photographic materials, comprising:

a) a lower phase comprising an alkaline aqueous solution wherein an inorganic antioxidant agent, a base and an inorganic buffering salt are dissolved; and b) an upper phase comprising a color developing agent and a photographically inert single ring heterocyclic amide, the color developing agent and the photographically inert single ring heterocyclic amide are in the upper phase where the color developing agent is more soluble in the photographically inert single ring heterocyclic amide than in said lower phase alkaline aqueous solution.

Because the developing agent is more soluble in the upper phase containing the photographically inert single ring heterocyclic amide, a greater concentration of developing agent can be included in the concentrate.

In accordance with this invention it has been discovered that concentrated color developing replenisher solutions can be prepared by combining conventional photographic processing agents with a photographically inert single ring heterocyclic amide.

A method has been found for preparing a single unit package containing all active ingredients for a one-part multi-phase concentrated replenishing solution with extended shelf stability for color developing of photographic materials comprising the following steps of:

a) forming an aqueous solution comprising a color developing agent, an inorganic antioxidant agent, and a photographically inert single ring heterocyclic amide;

b) elevating the pH of the aqueous solution of step (a) to a higher alkaline range;

c) introducing a sufficient amount of an inorganic buffering salt to the aqueous solution of step (b) forming the multi-phase solution; and d) introducing at least one photographic agent into the multi-phase solution.

Alternatively, a method to prepare a single unit package containing all active ingredients for a one-part multi-phase concentrated replenishing solution includes combining at least two concentrated solutions comprising the following steps:

a) providing an aqueous solution comprising a color developing agent and a photographically inert single ring heterocyclic amide;

b) providing an alkaline aqueous solution comprising an inorganic buffering salt; and c) mixing substantially simultaneously the solutions of step (a)and (b) in a proportional range sufficient to provide said concentrated replenishing solution. The solutions of step (a) and step (b) are added to the single unit package to form the one-part multi-phase replenishing solution wherein the aqueous solution of step (a) forms an upper phase and the alkaline aqueous solution of step (b) forms a lower phase.

A third solution can be combined with the aqueous solution of step (a) and the alkaline aqueous solution of step (b) to be added to the single unit package comprising additional photographic processing agents including an optical brightener, a preservative, a chelating agent, a wetting agent, an organic solvent, a development accelerator and a mixture thereof. Alternatively, the additional photographic processing agents may be added to the alkaline aqueous solution. Also, the at least two solutions may be added consecutively.

The one-part multi-phase concentrated replenishing solution yields a working replenishing solution having a pH between about 10 and about 11 upon dilution 1:9 with water for color developing of photographic materials.

DESCRIPTION OF THE PREFERRED EMBODIMENTS

This present invention provides methods and solutions of multi-phase concentrated color developing replenishers, packaged in a single unit, wherein the color developing agent is protected from deterioration which normally occurs in a highly alkaline compositions used heretofore. It has been found that the decomposition of the color developing agent can be substantially eliminated by the addition of a photographically inert single ring heterocyclic amide to the concentrated replenishing solutions. The photographically inert single ring heterocyclic amide has advantageous effects in preventing deterioration of the color developing agent by providing an upper phase wherein the color developing agent is more soluble than in the lower phase which has a high alkaline pH. Hence, the concentrated replenishing solutions have extended shelf life and can easily be diluted with water to prepare working solutions to be utilized in the development of various photographic papers and films.

Photographic development is the chemical reduction to metallic silver of silver halide crystals which have a latent image due to exposure to light. Developing agents reduce exposed silver halide to metallic silver while not affecting the unexposed silver halide. In color photography the colors are formed where the film has been exposed to light. Almost all of today's color developing processes are based on a single chemical procedure known as dye-coupling development. Currently available color developing agents are developers of the latent silver image, but do not couple with dye formers in their normal state. Instead, the developing agents oxidation products that result from the development of the silver image can and will couple with dye formers to produce a color image.

Color developing agents for silver halide emulsions which are well known among those skilled in the art and widely used in the photographic industry, can be advantageously employed in the concentrated replenishing compositions of the present invention. Representative developing agents may be selected from compounds having the general formula of

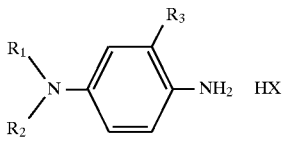

(I)

wherein $R_1$ and $R_2$ can be independently selected from the group consisting of an alkyl group having 1 to 4 carbon atoms, alkoxy group having 1 to 4 carbon atoms, alkyl-substituted sulfonamidomethyl group, an alkyl-substituted sulfonic acid group; wherein $R_3$ is a hydrogen atom, alkyl group having 1 to 4 carbon atoms, alkoxy group having 1 to 4 carbon atoms and alkyl-substituted amino group; and wherein X can be Cl, $SO_4$, or $SO_2$. Preferred representatives of useful color developers within formula (I) include N,N-diethyl paraphenylenediamine hydrochloride, N,N-diethyl paraphenylenediamine sulfur dioxide, 4-amino-3-methyl-N-ethyl-N-(2-hydroxyethyl) aniline sulphate, para-hydroxyethylethylamino aniline sulphate, 4-(N-ethyl-N-2-methanesulfonylaminoethyl)-2-methylphenylenediamine sesquisulfate, 2-amino-5-diethyl-aminotoluene hydrochloride and more preferably, 4-(N-ethyl-N-2-methanesulfonylaminoethyl)-2-methylphenylenediamine sesquisulfate.

Generally, color developing agents should be used in an amount that is sufficient to preferentially reduce the silver halide grains of the emulsions which have been exposed to light and further couple with dye formers. The color developing agent is typically present in an amount from about 2 to about 12 percent based on total weight of the concentrated multi-phase solutions of this invention. More specifically, color image forming occurs when the developing agent in the concentrated solutions is from about 3 to about 9 percent based on total weight. Unless otherwise stated, the parts and percentages are by weight.

Replenishing solutions and the developing agents dissolved therein have a tendency to react with oxygen in air, producing products that color and cloud the solution. If this is allowed to happen to any great degree the solution becomes useless. Therefore, most color developer replenishing formulas call for the addition of an antioxidant agent acting as a preservative that has an affinity for oxygen and tends to attract oxygen from the air and water in preference to other active components in the replenishing solution. However, as stated above, the oxidation product of the developing agent couples with the color former to produce a dye. Obviously, then, the color developer formula cannot contain a large amount of an antioxidant agent, since this will inhibit the color developing agent's action in the formation of a color image.

A wide variety of effective inorganic antioxidant agents known in the photographic developing art may be utilized in this invention. The most common and universally used inorganic antioxidant agents include alkali metal sulfites. Representative examples include: sodium sulfite, potassium sulfite, sodium bisulfite, potassium bisulfite, sodium metabisulfite, and potassium metabisulfite. Generally, a sufficient amount of the inorganic antioxidant agent is used to counteract the tendency of other active components to oxidize rapidly and lose their effectiveness. More specifically, optimum preservation is achieved with amounts from about 0.1 to about 3 percent based on total weight of the concentrated multi-phase compositions of this invention, and more optimally in an amount from about 0.1 to about 0.5 percent.

As stated earlier, it has been found that the addition of a photographically inert single ring heterocyclic amide prevents deterioration of color developing agents by providing a medium in which they are more soluble. Advantageously, with this increased solubility there is a concurrent increase in the amount of developing agent that can be added to the concentrated replenishing solutions. Water soluble single ring heterocyclic amides useful in the formulation of the liquid concentrated color developing replenisher compositions of the present invention have the general formula:

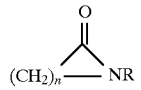

(II)

wherein R is a hydrogen atom, alkyl group having 1 to 4 carbon atoms, aminoalkyl group having 1 to 6 carbon atoms and n is 2 to 7. Representative examples include: 2-azetidinone (β-propiolactam), 2-pyrrolidone (γ-butyrolactam), 2-piperidone (δ-valerolactam), ε-caprolactum (6-hexanolactam), enantholactam (7-heptanolactam), caprylactam (8-octanolactan) and N-methyl-2-pyrrolidone, and preferably ε-caprolactum.

It is beneficial to employ the photographically inert single ring heterocyclic amide in a sufficient amount to stabilize the color developing agent. Preferably, the single ring heterocyclic amide can be added in an amount for about 5 to about 15 percent, and more preferably, from about 7 to about 10 percent.

When development of silver halide takes place a hydrogen ion is produced for each atom of metallic silver formed. Because the bromide in the original developing solution and hydrogen ion together constitute an acid, the reaction proceeds more readily in an alkaline solution, which neutralizes the acid as it is formed. The reducing power of the color developer in the replenishing solutions is thus controlled by adjusting the alkalinity of the concentrated replenishing solutions. The adjustment of pH in the replenishing solutions containing the inorganic antioxidant agent and color developing agent is accomplished with the introduction of a base. As employed herein, the term "base" refers to a substance that produces hydroxide ions in aqueous solution, or a substance that can accept a proton. Practically any base that is suitable for photographic processing can be utilized to adjust the pH sufficiently to a higher alkaline range. These bases may include nitrogen bases such as ammonia, alkali metal or alkaline earth metal hydroxides, such as sodium hydroxide, potassium hydroxide and barium hydroxide, and organic bases with a $K_B$ greater than $1\times10^{-4}$, such as methyl amine.

Generally, the pH adjusting agent should be used in an amount sufficient to be effective in raising the pH of the aqueous solution containing the antioxidant agent, color developing agent and photographically inert single ring heterocyclic amide to a range from about 10 to about 12, and more preferably, in a range from about 10.5 to about 11. The pH adjusting agent is typically present in an amount from about 0.5 to about 5 percent based on total weight of the concentrated solutions. In practicing the invention, it is advantageous to employ sodium hydroxide in an amount from about 1 to about 3 percent based on total weight.

The stability of a color developer is seriously affected by the pH. Because the reducing potential of all developing agents increases as the pH increases, the rate of reaction with oxygen will also increase. Thus, a high pH makes a developer more susceptible to aerial oxidation, which may be counteracted with additional preservatives, additional developing agents or by protection from oxygen. When most color developers are oxidized by air, hydroxyl ions are produced which tend to raise the pH still higher. Therefore, the solution should be well buffered. Because the activity of a color developing agent in the replenishing solution depends in a large part upon the pH of the solution, most replenishers contain a buffering agent whose function is to maintain the proper pH for the desired activity level. Accordingly, most buffering agents known in photographic processing may be utilized in this invention to obtain and maintain a limited pH range. Specific representative examples of effective inorganic buffering agents include: sodium bicarbonate, sodium carbonate and potassium carbonate.

Generally, the buffering agent should be used in an amount sufficient to maintain a limited pH range for enhancing the effect on development of the photographic materials. More preferably, a buffering agent is present in an amount from about 10 to about 25 percent based on total weight of the concentrated replenishing solution. The preferably useful inorganic buffering agent, potassium carbonate, is introduced into the concentrated replenishing solution in an amount ranging from about 13 to about 20 percent.

With the addition of the inorganic buffering salt the concentrated replenishing solution forms the multi-phase concentrate. A full explanation for the superior characteristics of the concentrated replenishing solutions in accordance with the invention has not yet been arrived at. Without limitation and by way of theory only, it has been suggested that the inorganic buffering salts form a highly concentrated ionic solution wherein the photographically inert single ring heterocyclic amide is pushed out of solution to collect in the upper phase away from the highly ionic environment of the lower phase. Collecting the photographically inert single ring heterocyclic amide in the upper phase provides a more favorable medium for holding the color developing agent which is more stable than if situated in the alkaline lower phase.

These multi-phase concentrates provide an environment wherein the color developing agent is protected from deterioration which normally occurs in a highly alkaline environment. Additionally, they provide the ability to increase the concentration of developing agent in the diluted working product of the replenishing solution.

In a typical replenishing concentrate other optional photographic processing agents may be added to secure special results. Some of these optional agents include optical brighteners, wetting agents, development accelerators, organic solvents, additional antioxidant agents, and chelating or sequestering agents.

With the incorporation of an optical brightener in the concentrated replenishing solutions the white areas of photographic prints are made to look whiter. The optical brightening agent fluoresces on irradiation with ultraviolet (UV) light, emitting visible light, usually bluish in hue, thus enhancing the whiteness of the object. Any optical brightening agent used in photographic processing that absorbs UV light in the region from about 330 to about 400 MU and efficiently convert this invisible light into visible light may be used in this present invention to enhance the whiteness of the photographic print. Preferably, any polysulphonated Bis (s-triazinylamino) stilbene-2,2'-disulphonic acid may be used, such as disclosed in U.S. Pat. Nos. 3,479,349 and 3,589,921 and incorporated herein by reference.

Generally, a sufficient amount of optical brightener is used to enhance the whiteness of photographic printing material. Preferably, 4,4'-Bis-2-diethylamino-4-(2,5-disulphophenylamino)-s-triazinyl-6-amino-stilbene-2.2'-disulphonic acid is added in an amount from about 0.1 to about 2 percent, and more preferably, from about 0.5 percent to about 1 percent.

A surfactant may be introduced into the concentrated replenisher solutions to increase the solubility of the developer and to act as a wetting agent. Surfactants have multiple uses in photographic solution: (1) A surfactant produces stable interfaces between organics and other materials and water. (2) They impart certain properties to the aqueous solution such as better wetting, flow, etc. The wetting agent improves the coatability of the film as it enters the replenishing solution by the elimination of air bubbles. Any conventional wetting agent utilized in photographic processing can be introduced to ensure rapid and uniform penetration of the film emulsion by the replenishing solutions of this invention. There are two basic types of solubilizing or wetting agents, such as the anionic type which includes compounds of the type $RSO_3Na$ and $RSO_4Na$ wherein R is an alkyl group having from about 5 to about 20 carbon atoms which may contain heterocyclic substituents and sodium alkyl aryl sulfonates having from about 7 to about 20 carbon atoms; and the non-ionic type compounds, such as saponin, polyethyleneglycol and its derivatives. In this invention it has been found that an anionic surfactant is a most useful wetting agent.

Generally, the wetting agent should be used in a sufficient amount to be effective in wetting the film as it enters the developing solution replenished by the concentrate of the present invention. More specifically, the wetting agent is present in an amount from about 0.2 to about 5 percent. Preferably, the wetting agent is an alkyl aryl sulfonate, and more preferably, a mixture of alkylated diphenyloxide disulfates is added to the concentrated replenisher solutions in an amount from about 0.5 to about 1 percent based on total weight of the concentrate.

In the developing of photographic images, a chelating agent is often utilized in color developing replenisher solutions to form stable, soluble complexes with trace metal impurities in the solution. Most chelating agents utilized in photographic developing and replenishing solutions may be utilized successfully in this present invention. Particularly useful examples of chelating agents may include: ethylenediaminetetraacetic acid (EDTA), diethylenetriamine-pentaacetate pentasodium salt ($DTPANa_5$), triethylenetetramine-hexaacetic acid, hydroxyethylethylenediaminetriacetic acid, nitrilotriacetic acid (NTA), 1:2-diamino-cyclohexanetetraacetic acid, 1:3-diamino-2-propanoltetraacetic acid, dipicolinic acid, bis-hydroxyphenylethylenediamine-diacetic acid, sodium hexametaphosphate, tetrasodium-pyrophosphate, sodium tripoly-phosphate, sodium tri-metaphosphate and a lithium salt in combination with an organic phosphonate, such as 1-hydroxyethylidene-l,1-diphosphonic acid. Preferably, $DTPANa_5$ is useful to eliminate impurities in the aqueous solution.

Generally, the chelating agent should be used in a sufficient amount to be effective in complexing unwanted impurities in the developing solution. More specifically, the chelating agent should be present in the concentrated replenishing solutions in an amount from about 1 to about 5 percent, and more preferably, from about 2 to about 4 percent based on total weight.

To augment the sequestering power of the above chelating agent, especially in a highly alkaline solution, additional sequestering agents may be used in conjunction with the group mentioned above. If the added sequestering agent is less than stoichiometric quantities based on calcium ions in solution, then relatively hard precipitates are formed which interfere with the development of photographic recording materials. Therefore, the addition of polymaleic acid will sequester the calcium ions and will aid in the avoidance of precipitation of sparingly soluble calcium compounds when water evaporates from the developing baths.

A sufficient amount of the polymaleic acid to sequester calcium ions should be introduced into the concentrated replenishing solutions. In particular, the polymaleic acid may be used in an amount from about 1 to about 5 percent, and preferably, from about 2 to about 4 percent.

Added protection against aerial oxidation of the developing agent can be obtained by the presence of other antioxidants in addition to the sulfites mentioned above. Because the sulphite content in color developing solutions is necessarily low, additional antioxidants are usually incorporated to improve keeping properties. Accordingly, any antioxidant that inhibits aerial oxidation may be used in the present invention. The preferred antioxidant agent is a member selected from the group consisting of hydroxylamine, diethylhydroxylamine, hydrazine, ascorbic acid, and tetronimides. In particular, diethylhydroxylamine has been found to give the best results.

Generally, the antioxidant agents are used in an amount sufficient to prevent aerial oxidation of the developing agent. More specifically, the antioxidant agent is present in an amount from about 2 to about 10 percent by weight. Preferably, the antioxidant diethylhydroxylamine is added to the concentrated replenishing solutions in an amount from about 3 to about 5 percent based on total weight of the concentrate.

Several different types of compounds increase the rate of development and are referred to as development accelerators. These compounds include organic amines, such as diethanolamine, triethanolamine, monoethanolamine, ethylenediamine, β-phenylethylamine and piperidine. Their mode of action is not completely clear, but the fact that these compounds posses definite, albeit, weak solvent properties for silver halide seems to be an important aspect. Also, they could be acting as additional antioxidants to supplement the low content of sulfites in the developing solutions that are being replenished by the present invention.

It is beneficial to employ the organic amines in a sufficient amount to accelerate development. Preferably, the organic amine can be added in an amount from about 1 to about 5 percent by weight.

The preparation of the liquid concentrates of the present invention can include the addition of a photographically neutral organic solvent. The incorporation of a water-miscible organic solvent allows for increased concentrations of active ingredients in the concentrated replenishing solution because of increased solubility of these active ingredients. This can be especially beneficial to increase the solubility of some color developing agents in a low or near neutral pH solution. These water-miscible organic solvents include ethylene glycol, diethylene glycol, triethylene glycol and hexylene glycol.

A sufficient amount of the water-miscible organic solvent to increase solubility of the active ingredients may be introduced into the concentrated replenishing solutions. In particular, the organic solvent can be used in an amount from about 1 to 5 percent.

For other and more particular details concerning the practice of this invention and the advantages thereof, reference is made to the following best mode examples.

EXAMPLE 1

In accordance with the invention, a multi-phase liquid concentrated color developing replenisher solution was prepared in the manner described hereinafter.

A one liter open flask was equipped with a motorized stirrer. At ambient temperature, an inorganic antioxidant agent, namely 4 grams of potassium sulfite was added to approximately 0.40 liter of deionized water and mixed throughly. Mixed with the aqueous solution containing the potassium sulfite was 70 grams of a color developing agent consisting of 4-(N-ethyl-N-2-methanesulfonylaminoethyl)-2-methylphenylenediamine sesquisulfate (CD-3). Also added to this aqueous solution was a photographically inert single ring heterocyclic amide, namely 120 grams of water soluble ϵ-caprolactum. All the components were dissolved in the aqueous solution and mixed to form an uniform aqueous solution. At this point an optical brightener was added, that being, 10 grams of 4,4'-Bis-2-diethylamino-4-(2,5-disulphophenylamino)-s-triazinyl-6-amino-stilbene-2.2'-disulphonic acid.

The pH of the aqueous solution was adjusted with 35 ml of a 50 percent solution of potassium hydroxide. Immediately, 240 grams of the buffering salt potassium carbonate was mixed into the solution. Additional processing agents were also added including: 30 ml of an aqueous solution of polymaleic acid, and 20 ml of a 40% solution of $DTPANa_5$ both of which acted as chelating agents. Also, 70 ml of a 85% solution of diethylhyroxylamine was added as an additional antioxidant agent and finally added was 8 ml of a mixture of alkylated diphenyloxide disulfonates, a commercially available wetting agent from Dow Chemical under the trade name Dowfax 3BO.

During the stirring of this solution the concentrated replenishing solution appeared as a yellow milky solution. However, upon settling a multi-phase concentrate formed. An upper phase had formed comprising both the ϵ-caprolactum and developing agent 4-(N-ethyl-N-2-methanesulfonylaminoethyl)-2-methyl-phenylenediamine sesquisulfate. A lower phase contained the alkaline aqueous solution comprising the other photographic processing agents. A third phase developed which was a relatively small amount of a yellow precipitate. The yellow precipitate was the optical brightener 4,4'-Bis-2-diethylamino-4-(2,5-disulphophenylamino)-s-triazinyl-6-amino-stilbene-2.2'-disulphonic acid which was freely floating through the entire concentrate.

The sample was shaken to simulate movement during transit or storage and it was discovered that the milky solution easily reverted to the multi-phase concentrate. The developing agent once again collected in the upper phase with the photographically inert single ring heterocyclic amide and was protected from the high alkaline lower phase. An accelerated test for determination of shelf life stability was conducted. This test was conducted on the concentrated solution in an oven at about 50° C. to about 55° C. for a month and the developing agent maintained its potency without significant deterioration.

The shelf life was tested by sealing 100 ml of the concentrated replenishing solution in 120 ml bottle and stored at room temperature. Each of the 120 ml bottles contain approximately 7 grams of active developing agent when sealed.

The following test data indicates that prolonged heating for a month or sitting on a shelf for at least ten months did not significantly reduced the concentration of the active developing agent.

| Test | Heated | 1-30-97 | 2-18-97 | 3-18-97 | 4-30-97 |
|---|---|---|---|---|---|
| pH | 10.68 | 10.69 | 10.68 | 10.68 | 10.67 |
| CD-3 | 5.8 g/l | 6.5 g/l | 6.1 g/l | 6.4 g/l | 6.3 g/l |
| 5-22-97 | 6-30-97 | 7-29-97 | 8-25-97 | 9-26-97 | 10-16-97 |
| 10.68 | 10.68 | 10.69 | 10.68 | 10.69 | 10.69 |
| 6.0 g/l | 6.2 g/l | 6.2 g/l | 6.3 g/l | 6.1 g/l | 6.4 g/l |

It should be noted that during the preparation of the concentrated replenishing solution some aerial oxidation of the developing agent occurred. Therefore, theoretically not the entire 7 grams of developing agent in each of the 100 ml bottles can be considered as an active reducing agent for developing photographic material. Also, it was found that only about 95 to about 97 percent of the developing agent was retained in the photographically inert single ring heterocyclic amide. Considering all these factors, the shelf life is expected to exceed a year without any appreciable deterioration of the developing agent

EXAMPLE 2

Another method of preparing the single unit package containing the one-part multi-phase concentrated replenishing solution involves making at least two and preferably three separate solutions and adding them together into the single unit package. With the addition of the three separate parts the multi-phase solution forms almost immediately.

Part A solution is prepared by dissolving 400 grams of ϵ-caprolactam, 5 grams of potassium sulfite and 234 grams of 4-(N-ethyl-N-2-methanesulfonylaminoethyl)-2-methylphenylenediamine sesquisulfate (CD-3)in 500ml of deionized water. Part A is further diluted to make 1 liter.

Part B solution is prepared by dissolving 800 grams of potassium carbonate in sufficient amount of deionized water to make 1 liter of solution.

Part C solution is prepared by dissolving additional photographic processing agents in 500 ml of deionized water. These include 25 grams of the optical brightener 4,4'-Bis-2-diethylamino-4-(2,5-disulphophenylamino)-s-triazinyl-6-amino-stilbene-2.2'-disulphonic acid, 175 ml of a 85% concentrated solution of the antioxidant diethylhyroxylamine, 19 ml of a mixture of alkylated diphenyloxide disulfonates, a commercially available wetting agent from Dow Chemical under the trade name Dowfax 3BO, 75 ml of polymaleic acid and 50 ml of a 40% solution of $DTPANa_5$ both of which acted as chelating agents. Part C aqueous solution is adjusted to an alkaline pH with the addition of 95 ml of a 50% concentrated solution of potassium hydroxide and further diluted with water to make 1 liter.

It should be noted that the pH adjusting agent can be added to solution Part C or solution Part B.

After preparation of the solutions Part A, B and C, they are added to the single unit package by adding 300 ml of Part A, 300 ml of Part B and 400 ml of Part C. These three parts can be added simultaneously or consecutively. After the addition of the three parts, the one-part concentrate separates into the multi-phases wherein the upper phase comprises the developing agent and single ring heterocyclic amide and an alkaline lower phase comprises other photographic processing agents.

I claim:

1. A one-part multi-phase liquid concentrated color developing replenisher composition comprising a photographically inert single ring heterocyclic amide and a developing agent such that said developing agent is solubilized in said photographically inert single ring heterocyclic amide and retained in an upper phase in said one-part multi-phase liquid concentrate color developing replenisher.

2. The composition of claim 1 further comprising an aqueous solution of at least one photographic processing agent in a lower phase of said one-part multi-phase liquid concentrated color developing replenisher.

3. The composition of claim 2 wherein said photographic processing agent is a member selected from the group consisting of a developing agent, a preservative, a buffering salt, a base and mixtures thereof.

4. The composition of claim 3 further comprising a chelating agent, an optical brightener, and a wetting agent.

5. The composition of claim 1 wherein said photographically inert single ring heterocyclic amide is ϵ-caprolactam.

6. The composition of claim 1 wherein said photographically inert single ring heterocyclic amide is selected from the group consisting of 2-azetidinone (β-propiolactam), 2-pyrrolidone (γ-butyrolactam), 2-piperidone (δ-valerolactam), ϵ-caprolactam(6-hexanolactam), enantholactam (7-heptanolactam), and capryllactam (8-octanolactam).

7. The composition of claim 4 wherein said photographically inert single ring heterocyclic amide comprises from about 5 to about 15 percent by weight of total composition.

8. A one-part multi-phase concentrated replenishing solution for color developing photographic material comprising:

an inorganic antioxidant agent;

a color developing agent;

a photographically inert single ring heterocyclic amide;

an alkaline pH adjusting agent; and an inorganic buffering salt;

creating a one-part multi-phase liquid concentrated color developing replenisher having an upper phase which comprises said developing agent solubilized in said photographically inert single ring heterocyclic amide and a lower phase which comprises said inorganic antioxidant agent, inorganic buffering salt and alkaline pH adjusting agent.

9. The solution of claim 8 wherein said photographically inert single ring heterocyclic amide is a member selected from the group consisting of 2-azetidinone (β-propiolactam), 2-pyrrolidone (γ-butyrolactam), 2-piperidone (δ-valerolactam), ϵ-caprolactam (6-hexanolactam), enantholactam (7-heptanolactam), and capryllactam (8-octanolactam).

10. The solution of claim 8 wherein said photographically inert single ring heterocyclic amide is ϵ-caprolactam.

11. The solution of claim 8 further comprising at least one additional photographic processing agent.

12. The solution of claim 11 wherein said at least one additional photographic processing agent is a member selected from the group consisting of an optical brightener, a chelating agent, an antioxidant agent, a wetting agent and a mixture thereof.

13. The solution of claim 9 wherein said inorganic antioxidant agent is a member selected from the group consisting of sodium sulfite, potassium sulfite, sodium bisulfite, potassium bisulfite, sodium metabisulfite and potassium metabisulfite.

14. The solution of claim 13 wherein said color developing agent is a member selected from the group consisting of N,N-diethyl paraphenylenediamine hydrochloride, N,N-diethyl paraphenylenediamine sulfur dioxide, 4-amino-3-methyl-N-ethyl-N-(2-hydroxyethyl)aniline sulphate, para-hydroxyethylethylamino aniline sulphate, 4-(N-ethyl-N-2-methanesulfonylaminoethyl)-2-methylphenylenediamine sesquisulfate, 2-amino-5-diethyl-aminotoluene hydrochloride.

15. The solution of claim 14 wherein said alkaline pH adjusting agent is a member selected from the group consisting of ammonia, alkali metal hydroxides, alkaline earth metal hydroxides and methyl amine.

16. The solution of claim 15 wherein said inorganic buffering salt is a member selected from the group consisting of sodium bicarbonate, sodium carbonate and potassium carbonate.

17. The solution of claim 8 wherein said concentrated replenishing solution is characterized by (1) an aqueous lower phase having a pH above 10 comprising said inorganic antioxidant, inorganic buffering salt and alkaline pH adjusting agent dissolved in said aqueous lower phase and (2) an upper phase comprising said color developing agent and said photographically inert single ring heterocyclic amide where said color developing agent is soluble in said photographically inert single ring heterocyclic amide and retained away from said alkaline lower phase.

18. The solution of claim 12 wherein said wetting agent is a member selected from the group consisting of diethylene glycol, saponin, sodium alkyl sulfonates having from about 5 to about 20 carbon atoms, sodium alkyl sulfates having from about 5 to about 20 carbon atoms and sodium alkyl aryl sulfonates having from about 7 to about 20 carbon atoms.

19. The solution of claim 18 wherein said chelating agent is a member selected from the group consisting of ethylenediaminetetraacetic acid (EDTA), diethylenetriaminepentaacetate pentasodium salt ($DTPANa_5$), triethylenetetraminehexaacetic acid, hydroxyethylethylenediaminetriacetic acid, nitrilotriacetic acid (NTA), 1:2-diamino-cyclohexanetetraacetic acid, 1:3-diamino-2-propanoltetraacetic acid, dipicolinic acid, bis-hydroxyphenylethylenediamine-diacetic acid, sodium hexametaphosphate, tetrasodium-pyrophosphate, sodium tripolyphosphate, sodium tri-metaphosphate, polymaleic acid and a lithium salt in combination with an organic phosphonate.

20. The solution of claim 19 wherein said optical brightener is a polysulfonated Bis (s-triazinylamino)stilbene-2,2'-di-sulfonic acid.

21. A method of preparing a single unit multi-phase concentrated replenishing solution for color developing photographic material comprising the following steps of:

a) forming an aqueous solution comprising a color developing agent, an inorganic antioxidant agent, and a photographically inert single ring heterocyclic amide;

b) elevating the pH of the aqueous solution of step (a) to a higher alkaline range; and c) introducing a sufficient amount of an inorganic buffering salt to the aqueous solution of step (b) so that said color developing agent and said photographically inert single ring cyclic amide collect in an upper phase, and an alkaline aqueous solution comprising said inorganic antioxidant agent and said inorganic buffering salt form a lower phase thereby creating said multi-phase concentrated replenishing solution.

22. The method of claim 21 wherein said photographically inert single ring heterocyclic amide is a member selected from the group consisting of 2-azetidinone (β-propiolactam), 2-pyrrolidone (γ-butyrolactam), 2-piperidone (δ-valerolactam), ε-caprolactam(6-hexanolactam), enantholactam (7-heptanolactam), and capryllactam (8-octanolactam).

23. The method of claim 21 wherein said photographically inert single ring heterocyclic amide is ε-caprolactam.

24. The method of claim 21 wherein said color developing agent is a member selected from the group consisting of N,N-diethyl paraphenylenediamine hydrochloride, N,N-diethyl paraphenylenediamine sulfur dioxide, 4-amino-3-methyl-N-ethyl-N-(2-hydroxyethyl)aniline sulphate, para-hydroxyethylethylamino aniline sulphate, 4-(N-ethyl-N-2-methanesulfonylaminoethyl)-2-methyl phenylenediamine sesquisulfate, 2-amino-5-diethyl-aminotoluene hydrochloride.

25. The method of claim 21 wherein said color developing agent is a p-phenylenediamine derivative.

26. The method of claim 25 wherein said color developing agent is 4-(N-ethyl-N-2-methanesulfonylaminoethyl)-2-methyl-phenylenediamine sesquisulfate.

27. A method of preparing a one-part multi-phase concentrated replenishing solution comprising the following steps:

a) providing an aqueous solution comprising a color developing agent and a photographically inert single ring heterocyclic amide;

b) providing an alkaline aqueous solution comprising an inorganic buffering salt; and c) mixing substantially simultaneously the solutions of step (a)and (b) in a proportional range sufficient to provide said one-part multi-phase liquid concentrated replenishing solution having an upper phase comprising said developing agent solubilized in said photographically inert single ring heterocyclic amide and a lower phase comprising said alkaline aqueous solution.

28. The method of claim 27 wherein said alkaline aqueous solution further comprises at least one member selected from the group consisting of an optical brightener, a preservative, a chelating agent, a wetting agent, an organic solvent, a development accelerator and a mixture thereof.

29. The method of claim 27 wherein said photographically inert single ring heterocyclic amide is a member selected from the group consisting of 2-azetidinone (β-propiolactam), 2-pyrrolidone (γ-butyrolactam), 2-piperidone (δ-valerolactam), ε-caprolactam (6-hexanolactam), enantholactam (7-heptanolactam), and capryllactam (8-octanolactam).

30. The method of claim 27 wherein said color developing agent is a member selected from the group consisting of N,N-diethyl paraphenylenediamine hydrochloride, N,N-diethyl paraphenylenediamine sulfur dioxide, 4-amino-3-methyl-N-ethyl-N-(2-hydroxyethyl)aniline sulphate, para-hydroxyethylethylamino aniline sulphate, 4-(N-ethyl-N-2-methanesulfonylaminoethyl)-2-methylphenylenediamine sesquisulfate, 2-amino-5-diethyl-aminotoluene hydrochloride.

31. The method of claim 27 wherein said photographically inert single ring heterocyclic amide is ε-caprolactam.

32. The method of claim 31 wherein said color developing agent is 4-(N-ethyl-N-2-methanesulfonylaminoethyl)-2-methylphenylenediamine sesquisulfate.

33. The method of claim 28 wherein said optical brightener is a polysulfonated Bis (s-triazinylamino)stilbene-2,2'-di-sulfonic acid.

* * * * *